US010533340B1

(12) United States Patent
Ohanesian

(10) Patent No.: US 10,533,340 B1
(45) Date of Patent: Jan. 14, 2020

(54) RACKABLE FENCE PANEL

(71) Applicant: U.S. POLYMERS, INC., Montebello, CA (US)

(72) Inventor: Viken Ohanesian, San Juan Capistrano, CA (US)

(73) Assignee: U.S. POLYMERS, INC., Montebello, CA (US)

( * ) Notice: Subject to any disclaimer, the term of this patent is extended or adjusted under 35 U.S.C. 154(b) by 290 days.

(21) Appl. No.: 15/408,198

(22) Filed: Jan. 17, 2017

Related U.S. Application Data

(63) Continuation of application No. 15/260,107, filed on Sep. 8, 2016, now abandoned.

(60) Provisional application No. 62/215,980, filed on Sep. 9, 2015.

(51) Int. Cl.
*E04H 17/16* (2006.01)
*E04H 17/14* (2006.01)
*E04H 17/22* (2006.01)

(52) U.S. Cl.
CPC ..... *E04H 17/168* (2013.01); *E04H 17/1421* (2013.01); *E04H 17/1426* (2013.01); *E04H 17/22* (2013.01)

(58) Field of Classification Search
CPC ..... E04H 17/1426; E04H 17/143; E04H 17/1439; E04H 17/1443
See application file for complete search history.

(56) References Cited

U.S. PATENT DOCUMENTS 5,454,548 A * 10/1995 Moore ..... E04H 17/1443 256/22
5,660,378 A * 8/1997 Schall ..... E04H 17/1439 256/22
6,375,166 B1 * 4/2002 Schall ..... E04H 17/1439 256/21
6,752,386 B1 * 6/2004 Bundy ..... E04H 17/1439 256/22
6,824,123 B2 11/2004 Larsen et al.
9,027,909 B1 * 5/2015 Peyton ..... E04H 17/1439 256/67
2009/0026431 A1 * 1/2009 Tremblay ..... E04H 17/1443 256/65.03
2010/0200827 A1 8/2010 Duffy et al.
2011/0001105 A1 * 1/2011 Lo ..... E04H 17/1443 256/65.08
2013/0181179 A1 * 7/2013 Langenwalter ..... E04H 17/1426 256/67

(Continued)

*Primary Examiner* — Michael P Ferguson
(74) *Attorney, Agent, or Firm* — Innovation Capital Law Group, LLP; Vic Lin

(57) ABSTRACT

A fence panel has pickets and rails with slots in the pickets and open bottom U shaped rails. A locking strip slides into the rail and the slots in the pickets to lock the pickets into the rail. The locking strip can be designed with a projecting L portion with a fingers formed between recessed slots along its length such that, at each picket interval, the pickets can pivot around the fingers. Thus, the lock strip allows pivoting of pickets. The rails are designed with a side internal slot with guides to hold the lock strip in place. The rails are further designed with a top internal groove to accept the insertion of a spacer strip that holds the pickets in place and stops them from moving left and right when the top of the pickets do not go through a routed top rail or a supporting middle rail.

20 Claims, 12 Drawing Sheets

(56) References Cited

U.S. PATENT DOCUMENTS

2013/0264532 A1* 10/2013 Goodman ..... E04H 17/1439
256/65.08

* cited by examiner

RACKABLE FENCE PANEL

CROSS-REFERENCE TO RELATED APPLICATIONS

This application is a continuation application of U.S. Non-Provisional Application having application Ser. No. 15/260,107 filed Sep. 8, 2016 and claims the benefit of priority to U.S. provisional patent application No. 62/215,980, filed Sep. 9, 2015, the contents of which are herein incorporated by reference.

BACKGROUND OF THE INVENTION

1. Field of the Invention

One or more embodiments of the invention relates generally to fence panels. More particularly, the invention relates to a rackable fence panel that allows fence pickets to pivot and the fence panel to rack along hillsides or slopes.

2. Description of Prior Art and Related Information

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The demand for aluminum fencing is growing rapidly. Aluminum fencing gives property owners the look of wrought iron, without wrought iron's cost, maintenance or durability issues. Unfortunately, many fabricators have shied away from this potentially lucrative market due to the large investment in equipment that aluminum fencing fabrication traditionally requires.

Typically, both aluminum and wrought iron fence panels are labor intensive and expensive to assemble because each picket has to attach to the horizontal rails with multiple fastening screws or multiple welds. Screws in aluminum fencing allow for the pickets to pivot for panel racking but the screws are visible and unsightly from one of the fence sides. The appearance of screws is undesirable for most customers. Furthermore, such fence panels are costly to assemble. In the case of welding iron, once welded, the pickets do not pivot at all for racking on hillsides. Welding is very costly and the iron fences need to be painted or powder coated only after they are fully assembled.

To solve this problem, a locking strip design has been created in the past which locks pickets into the rail. The problem with a locking strip is that it freezes a picket in place and does not allow for fencing pickets to pivot and panels to rack on hillsides and slopes.

In view of the foregoing, there is a need for an improved fence panel that permits racking while securely retaining the pickets in place.

SUMMARY OF THE INVENTION

Embodiments of the present invention provide a fence panel comprising a plurality of pickets; at least one notch formed on one side of each of the plurality of pickets; a rail having a top surface, a rail first side extending from the top surface, and a second opposite side extending from the top surface; and a lock bar formed with a lock bar first side positioned along an inside surface of the rail first side, and a planar extension extending from the lock bar first side and fitting at least partially into the notch in at least one of the plurality of pickets.

Embodiments of the present invention further provide a fence panel comprising a plurality of pickets; at least two notches formed on one side of each of the plurality of pickets; at least two rails each having a top surface, a rail first side extending from the top surface, and a second opposite side extending from the top surface, the rails positioned over each of the at least two notches; posts each secured at opposite ends of the at least two rails; at least a first and second tab extending into an interior region of the rails from at least the rail first side; and a lock bar fitting between the first and second tabs, the lock bar formed as an L-shaped elongated member with a lock bar first side slidable along an inside surface of the rail first side, and an extension portion extending outward from the lock bar first side, wherein the lock bar includes a plurality of picket receiving sections, one such picket receiving section for each of the plurality of pickets, each of the picket receiving sections including a cut out section disposed on opposite sides of a finger, wherein the cut out sections create a region without an extension fitting into the notch and the finger fits into the notch, wherein the picket can pivot at least up to a predetermined angle about the finger, wherein at least one of the at least two rails includes a middle rail having a plurality of holes formed along the top surface thereof, wherein the plurality of pickets are positioned in each of the plurality of holes.

Embodiments of the present invention also provide a fence panel comprising a plurality of pickets; at least two notches formed on one side of each of the plurality of pickets; at least two rails each having a top surface, a rail first side extending from the top surface, and a second opposite side extending from the top surface, the rails positioned over each of the at least two notches; posts each secured at opposite ends of the at least two rails; a lock bar formed as an L-shaped elongated member with a lock bar first side positioned along an inside surface of the rail first side, and a planar extension portion extending outward from the lock bar first side, wherein the lock bar includes a plurality of picket receiving sections, one such picket receiving section for each of the plurality of pickets, each of the picket receiving sections including a cut out section disposed on opposite sides of a T-shaped finger, wherein the cut out sections create a region without the planar extension fitting into the notch and the T-shaped finger fits into the notch, wherein the picket can pivot at least up to a predetermined angle about the T-shaped finger, wherein at least one of the at least two rails includes a middle rail having a plurality of holes formed along the top surface thereof, wherein the plurality of pickets is positioned in each of the plurality of holes.

These and other features, aspects and advantages of the present invention will become better understood with reference to the following drawings, description and claims.

BRIEF DESCRIPTION OF THE DRAWINGS

Some embodiments of the present invention are illustrated as an example and are not limited by the figures of the accompanying drawings, in which like references may indicate similar elements.

Figure 1A:
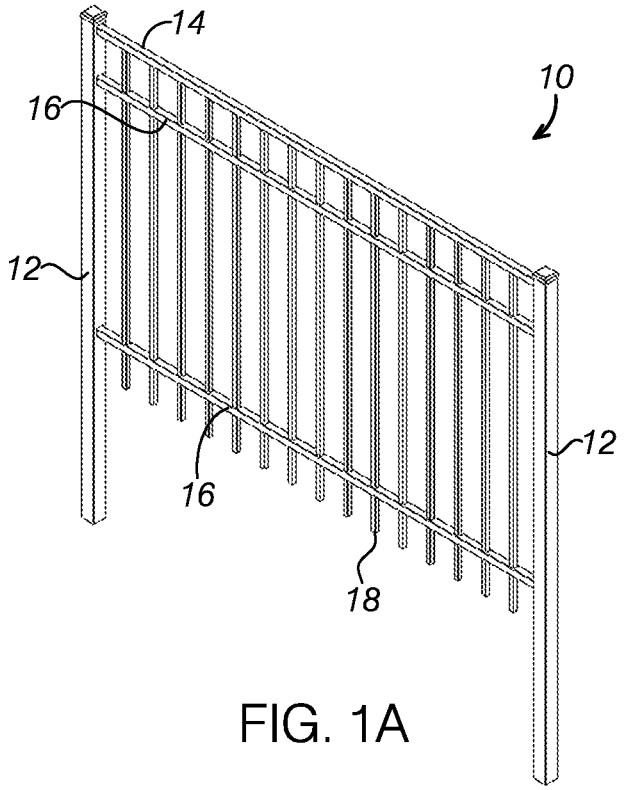
FIG. 1A illustrates a perspective view of a three-rail fence panel according to an exemplary embodiment of the present invention.

Unless otherwise indicated illustrations in the figures are not necessarily drawn to scale.

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE PREFERRED EMBODIMENTS AND BEST MODE OF INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

Devices or system modules that are in at least general communication with each other need not be in continuous communication with each other, unless expressly specified otherwise. In addition, devices or system modules that are in at least general communication with each other may communicate directly or indirectly through one or more intermediaries.

A description of an embodiment with several components in communication with each other does not imply that all such components are required. On the contrary, a variety of optional components are described to illustrate the wide variety of possible embodiments of the present invention.

As is well known to those skilled in the art, many careful considerations and compromises typically must be made when designing for the optimal configuration of a commercial implementation of any system, and in particular, the embodiments of the present invention. A commercial implementation in accordance with the spirit and teachings of the present invention may be configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

Broadly, embodiments of the present invention provide a fence panel with pickets and rails with slots in the pickets and open bottom U shaped rails. A locking strip slides into the rail and the slots in the pickets to lock the pickets into the rail. The locking strip can be designed with a projecting L portion with a fingers formed between recessed slots along its length such that, at each picket interval, the pickets can pivot around the fingers. Thus, the lock strip allows pivoting of pickets. The rails are designed with a side internal slot with guides to hold the lock strip in place. The rails are further designed with a top internal groove to accept the insertion of a spacer strip that holds the pickets in place and stops them from moving left and right when the top of the pickets do not go through a routed top rail or a supporting middle rail.

The fence panels, according to embodiments of the present invention, allow pickets to pivot up to about a 45-degree angle. The lock strip has sections around each picket that has a recessed slot portion and a projecting notch portion (finger) that locks each picket in place while allowing for the pickets to pivot up to about a 45-degree angle. The lock strip slips into the rail through the side internal slot so it doesn't move up and down. This provides fast and easy assembly by eliminating picket fastening screws so that there are no visible exterior fastening screws, resulting in a fence panel that is screwless on both sides while allowing the pickets to pivot so they can easily be installed on hillsides and slopes.

Many different sizes and styles of fence panels can be created via embodiments of the present invention. FIGS. 1A through 4B show just four examples of various styles of fence panels within the scope of the present invention. Of course, other styles, designs, shapes, sizes and the like, are contemplated within the scope of the present invention.

Figure 1B:
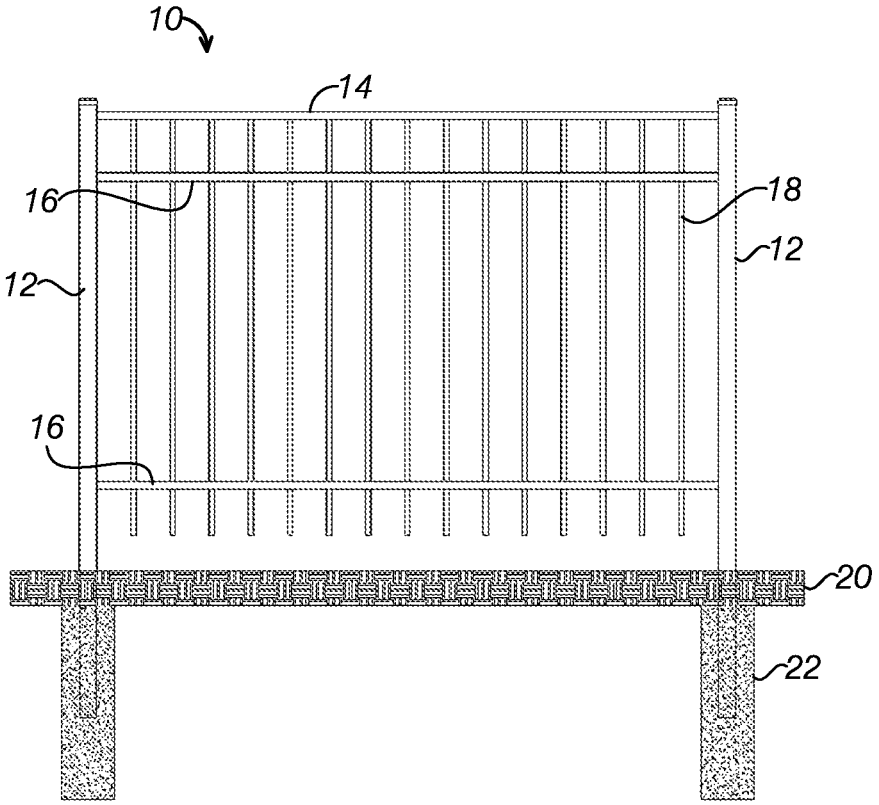
FIG. 1B illustrates a front view of the three-rail fence panel of FIG. 1A.

FIGS. 1A and 1B show one embodiment of a fence panel 10 having two middle or bottom rails (collectively referred to as middle rails 16) supporting a plurality of pickets 18. A top rail 14 disposed along a top edge of the pickets 18 lacks through holes for the pickets 18 to pass. Posts 12 may receive the rails 14, 16 therein to support the rails 14, 16 at a desired height. The posts 12 may be supported by various means, such as being disposed below ground 20 in a solid support, such as concrete 22.

Figure 2A:
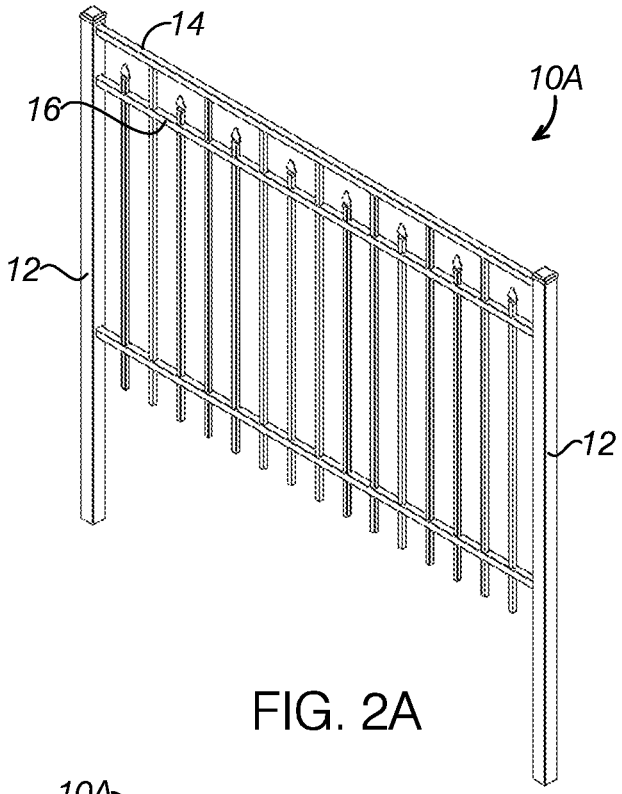
FIG. 2A illustrates a perspective view of a three-rail alternating picket design fence panel according to an exemplary embodiment of the present invention.
Figure 2B:
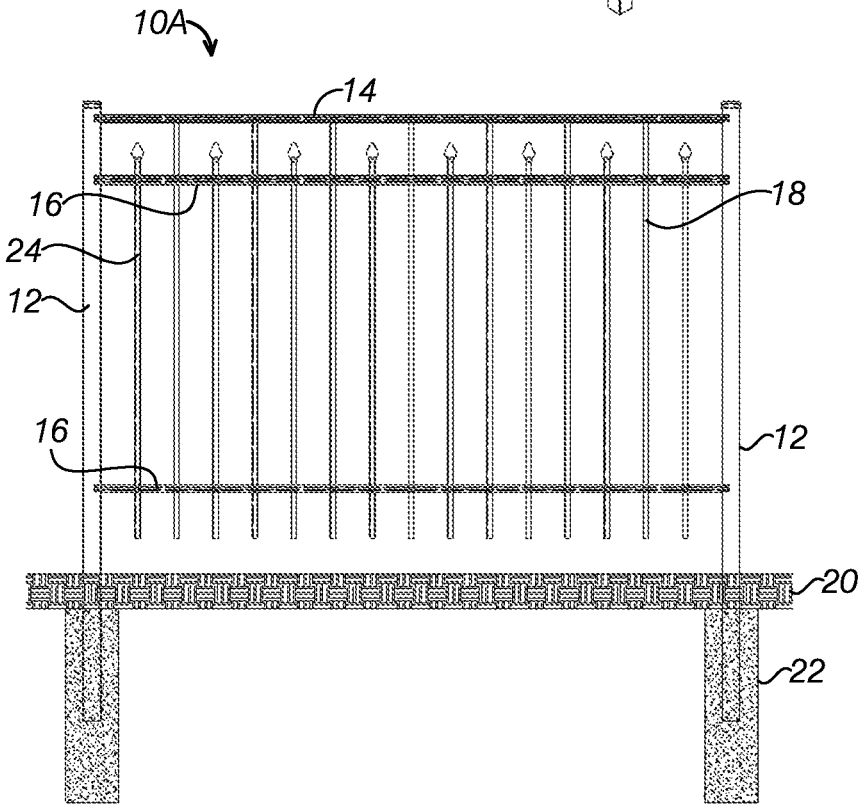
FIG. 2B illustrates a front view of the three-rail alternating picket design fence panel of FIG. 2A.

FIGS. 2A and 2B show another embodiment of a fence panel 10A. The fence panel 10A is similar to the fence panel 10 as described above, except for the following differences. In the fence panel 10A, alternating pickets 18 are replaced with a shortened picket 24 that does not reach the top rail 14. The shortened picket 24 may be terminated with a design, as shown, or may include other top designs or no top design.

Figure 3A:
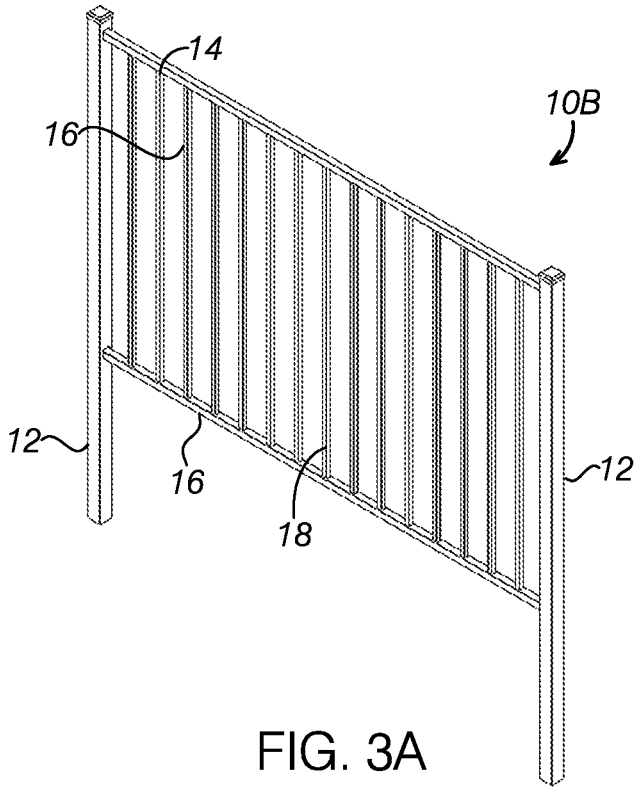
FIG. 3A illustrates a perspective view of a two-rail fence panel according to an exemplary embodiment of the present invention.
Figure 3B:
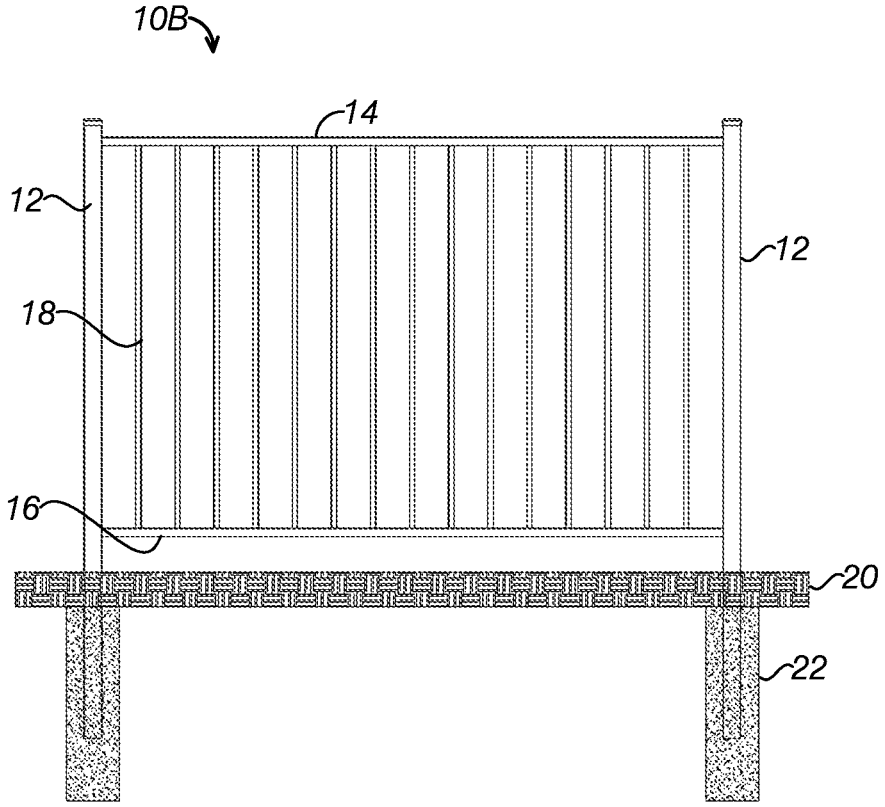
FIG. 3B illustrates a front view of the two-rail fence panel of FIG. 3A.

FIGS. 3A and 3B show another embodiment of a fence panel 10B. The fence panel 10A is similar to the fence panel 10 as described above, except for the following differences. In the fence panel 10B, the middle rail 16 is removed to provide a two-rail fence panel.

Figure 4A:
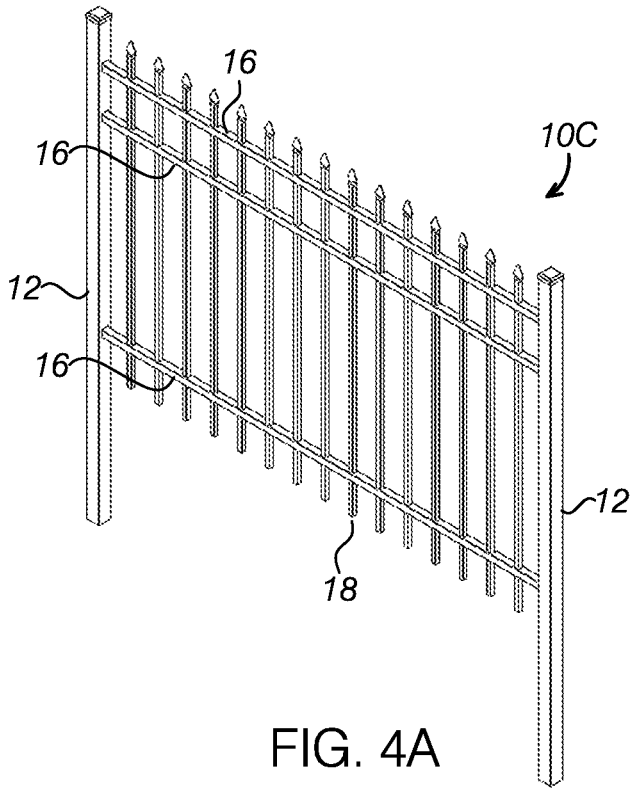
FIG. 4A illustrates a perspective view of a three-rail fence panel, without a top rail, according to an exemplary embodiment of the present invention.
Figure 4B:
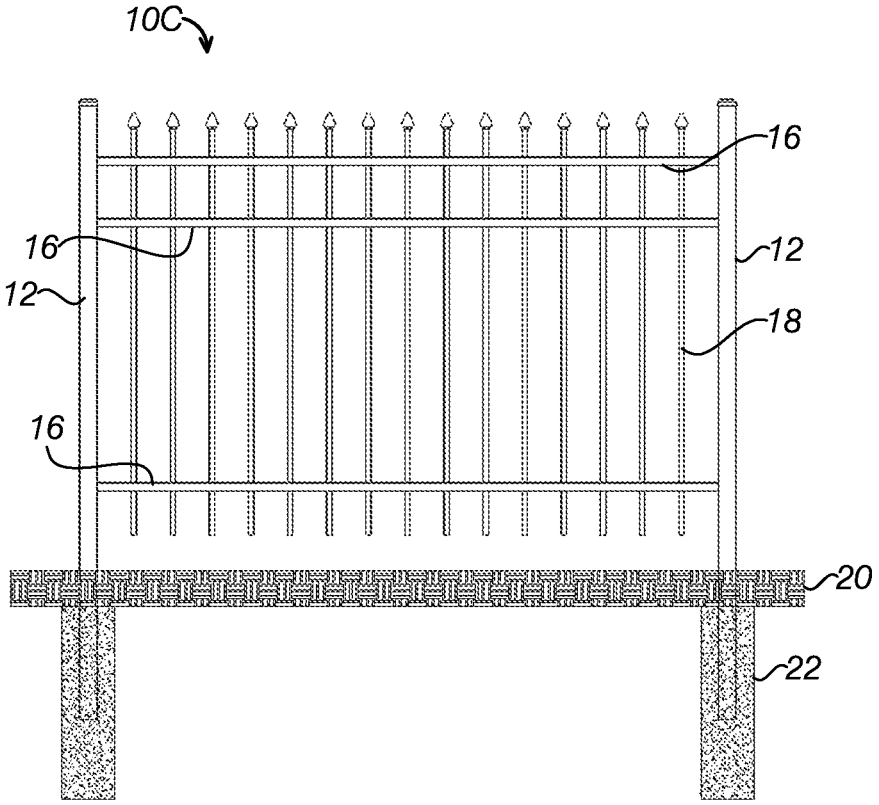
FIG. 4B illustrates a front view of the three-rail fence panel of FIG. 4A.

FIGS. 4A and 4B show another embodiment of a fence panel 10C. The fence panel 10C is similar to the fence panel 10 as described above, except for the following differences. In the fence panel 10C, there is no top rail 14, but three middle rails 16 are used to secure the pickets 18. While FIGS. 4A and 4C show a particular visible top design of the pickets 18, this top design may be different or absent, depending on the preference of the user.

FIGS. 1A through 4B, as noted above, show only four examples of fence panels that may be formed according to embodiments of the present invention. Other designs are contemplated within the scope of the present invention. For example, one of the upper middle rails 16 of the fence panel 10C may be eliminated, or additional middle rails 16 may be added as desired to any of the fence panels 10, 10A, 10B, 10C. Moreover, the height of the fence panels may vary, as desired and the number of pickets 18 between the posts 12, as well as the spacing between the pickets 18 may vary as desired by the user.

Figure 5A:
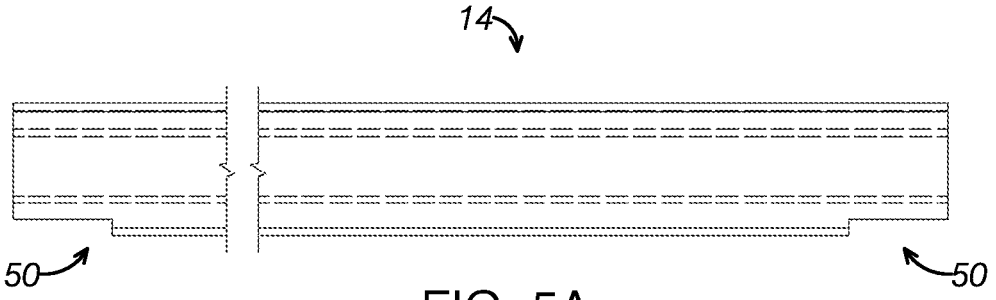
FIG. 5A illustrates a side view of a top rail usable in the fence panels of FIGS. 1A through 3B.
Figure 5B:
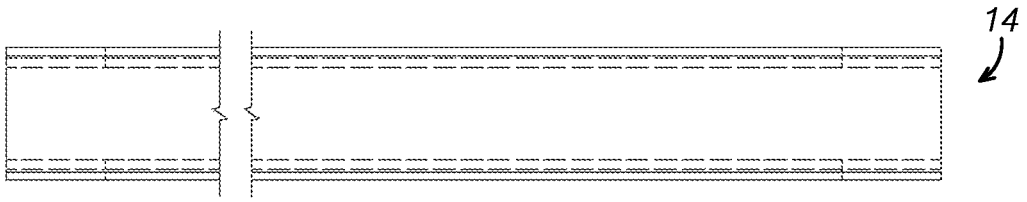
FIG. 5B illustrates a top view of the top rail of FIG. 5A.
Figure 5C:
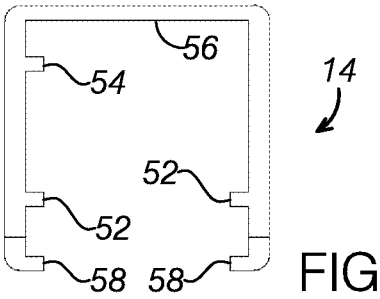
FIG. 5C illustrates an end view of the top rail of FIG. 5A.

Referring now to FIGS. 5A through 5D, the top rail 14 can include notches 50 on a bottom portion thereof, as shown in FIG. 5A. The notches 50 reduce the height of the top rail 14 to fit into the posts 12 on each end thereof. The top rail 14 may include a solid top surface 56, where the pickets 18 (see FIGS. 1A through 3B) do not extend therethrough. As described above, the top rail 14 may be formed in a generally U-shape, where the open end of the U-shape is disposed downward toward the ground 20. An upper tab 54 (disposed closest to the top surface 56) may protrude into the interior of the top rail 14, as shown in FIG. 5C. While this upper tab 54 is shown on one side of the top rail 14, a similar notch 54 may be disposed opposite upper tab 54. The upper tab 54 may be useful to retain a spacer strip 90 (see FIG. 9A), as described in greater detail below.

A locking strip 70 (see FIG. 7A) or a pivot locking strip 80 (see FIG. 8A) may be disposed between the upper tab 54 and a central tab 52 which protrudes into the interior of the top rail 14 at a location distal (relative to the top surface 56) the upper tab 54. While the central tab 52 is shown on both sides of the top rail 14, the central tab 52 may be disposed on only one side thereof, provided that it is on the same side as the upper tab 54. A lower tab 58 may extend inward at the base of the U-shaped top rail 14. Typically, the lower tab 58 extends from each side of the top rail 14 as shown in FIG. 5C. Each of the notches 52, 54, 58 extend a distance such that, when two opposing notches are present, the distance between the notches is the same as or slightly greater than the outside diameter of the pickets 18, thereby allowing the pickets to be inserted into the interior of the U-shaped top rail 14.

Figure 5D:
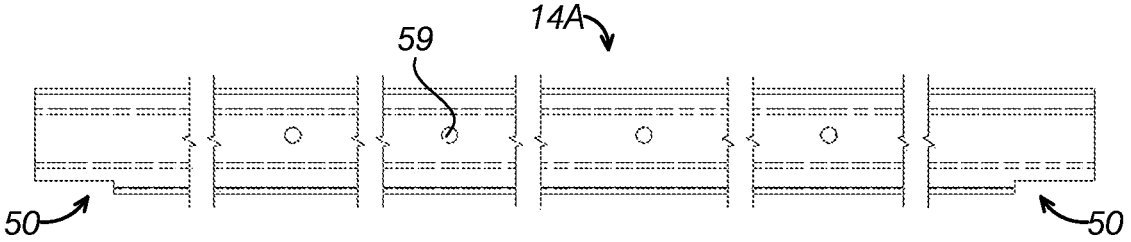
FIG. 5D illustrates a side view of a top rail with screw holes usable in the fence panels of FIGS. 1A through 3B.

In some embodiments, as shown in FIG. 5D, a plurality of holes 59 may be disposed on one or both sides of a top rail 14A. The holes 59 may align with locations of pickets 18, allowing a user to further secure the pickets 18 with a fastener, such as a screw, once the fence panel is in position and the desired racking is achieved.

Figure 6A:
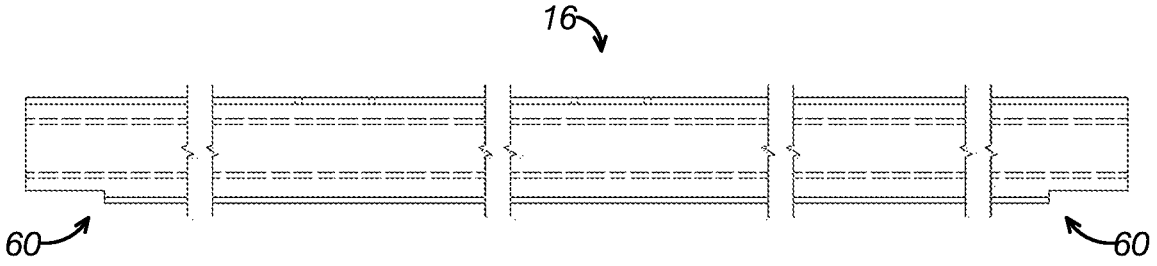
FIG. 6A illustrates a side view of a middle or bottom rail usable in the fence panels of FIGS. 1A through 4B.
Figure 6B:
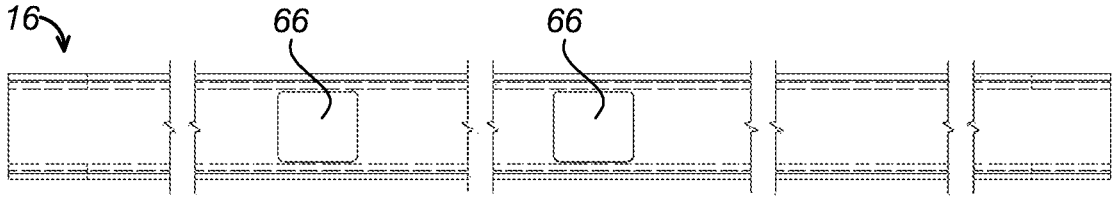
FIG. 6B illustrates a top view of the middle or bottom rail of FIG. 6A.
Figure 6C:
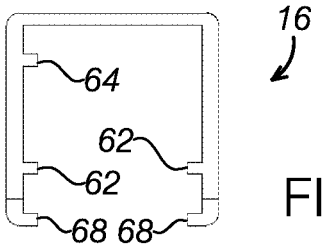
FIG. 6C illustrates an end view of the middle or bottom rail of FIG. 6A.

Referring now to FIGS. 6A through 6D, the middle rail 16 can include notches 60 on a bottom portion thereof, as shown in FIG. 6A. The notches 60 reduce the height of the middle rail 16 to fit into the posts 12 on each end thereof. The middle rail 16 may include openings 66 on its top surface, where the pickets 18 (see FIGS. 1A through 4B) extend therethrough. As described above, the middle rail 16 may be formed in a generally U-shape, where the open end of the U-shape is disposed downward toward the ground 20. An upper tab 64 (disposed closest to the top surface with the openings 66) may protrude into the interior of the middle rail 16, as shown in FIG. 6C. While this upper tab 64 is shown on one side of the middle rail 16, a similar notch may be disposed opposite upper tab 64. The upper tab 64 may be useful to retain a spacer strip 90 (see FIG. 9A), as described in greater detail below.

A locking strip 70 (see FIG. 7A) or a pivot locking strip 80 (see FIG. 8A) may be disposed between the upper tab 64 and a central tab 62 which protrudes into the interior of the middle rail 16 at a location distal (relative to the top surface) the upper tab 64. While the central tab 62 is shown on both sides of the middle rail 16, the central tab 62 may be disposed on only one side thereof, provided that it is on the same side as the upper tab 64. A lower tab 68 may extend inward at the base of the U-shaped middle rail 16. Typically, the lower tab 68 extends from each side of the middle rail 16 as shown in FIG. 6C. Each of the notches 64, 62, 68 extend a distance such that, when two opposing notches are present, the distance between the notches is the same as or slightly greater than the outside diameter of the pickets 18, thereby allowing the pickets to be inserted into the interior of the U-shaped middle rail 16.

Figure 6D:
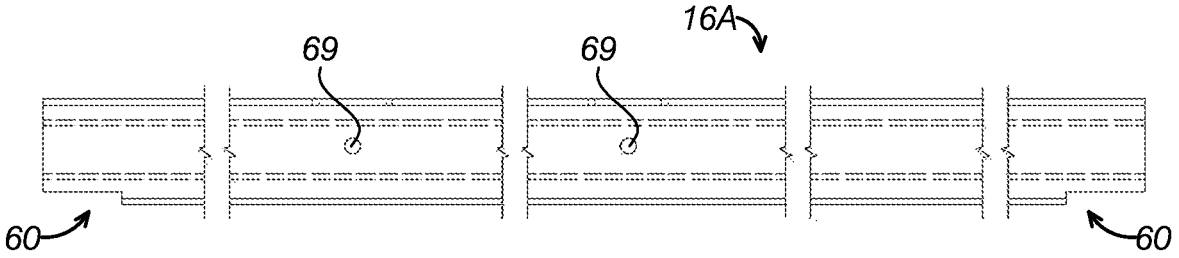
FIG. 6D illustrates a side view of a middle or bottom rail with screw holes usable in the fence panels of FIGS. 1A through 4B.

In some embodiments, as shown in FIG. 6D, a plurality of holes 69 may be disposed on one or both sides of a middle rail 16A. The holes 69 may align with locations of pickets 18, allowing a user to further secure the pickets 18 with a fastener, such as a screw, once the fence panel is in position and the desired racking is achieved.

Figure 7A:
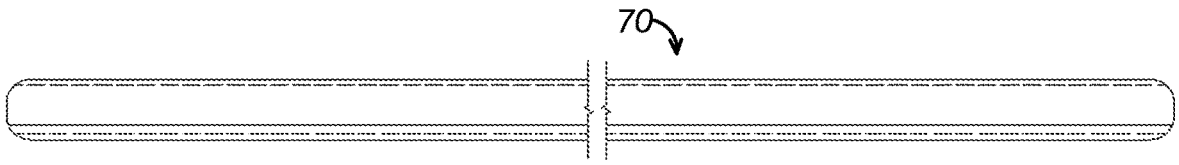
FIG. 7A illustrates a top view of a non-pivoting locking bar usable in the fence panels of FIGS. 1A through 4B.
Figure 7B:
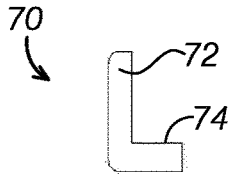
FIG. 7B illustrates an end view of the non-pivoting locking bar of FIG. 7A.

Referring to FIGS. 7A and 7B, a locking strip 70 (also referred to as a locking bar 70 or lock bar 70) can be formed as an L-shaped elongated member having a base 72 and an extending portion 74 that form the L-shape. The height of the base 72 may be chosen so that the locking bar 70 fits between the central tab 62 and the upper tab 64 of the middle rail 16 or between the central tab 52 and the upper tab 54 of the top rail 14. The extending portion 74 may fit into notches 100 (see FIGS. 10A through 10D), described below, cut into the pickets 18 to retain the pickets 18 vertically on the middle rail(s) 16 and/or the top rail 14. In the embodiment shown in FIGS. 7A and 7B, the locking strip 70 has a solid extending portion 74. Therefore, once positioned into the rail 16, 14 and the notch 100 of the picket 18, the picket 18 is not permitted to pivot. Locking strip 70 may be useful when forming fence panels to be used on flat or level ground, for example.

Figure 8A:
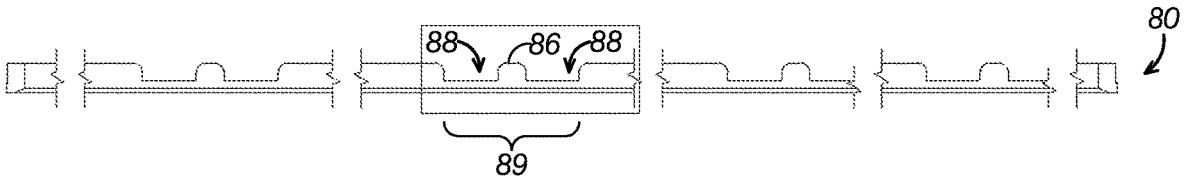
FIG. 8A illustrates a top view of a pivoting locking bar usable in the fence panels of FIGS. 1A through 4B.
Figure 8B:
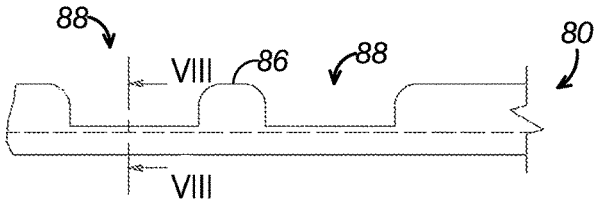
FIG. 8B illustrates a detailed top view of the pivoting locking bar of FIG. 8A.
Figure 8C:
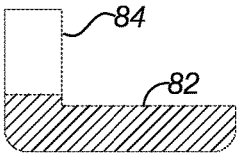
FIG. 8C illustrates a cross-sectional view of the pivoting locking bar of FIG. 8A taken along line VIII-VIII of FIG. 8B.

Referring now to FIGS. 8A through 8C, a pivot locking strip 80 (also referred to as a pivot locking bar 80 or pivot lock bar 80) can be formed as an L-shaped elongated member having a base 82 and an extending portion 84 that form the L-shape. The height of the base 82 may be chosen so that the pivot locking bar 80 fits between the central tab 62 and the upper tab 64 of the middle rail 16 or between the central tab 52 and the upper tab 54 of the top rail 14.

The extending portion 84 may fit into notches 100 (see FIGS. 10A through 10D), described below, cut into the pickets 18 to retain the pickets 18 vertically on the middle rail(s) 16 and/or the top rail 14. In the embodiment shown in FIGS. 8A through 8C, the pivot locking strip 80 has a segmented extending portion 84 having a picket receiving region 89 formed from cut-out portion 88, where the extending portion 84 is substantially removed, disposed on each side of a finger portion, or simply finger, 86. The finger 86 may be a planar member, typically in the same plane as the extending portion 84 of the pivot locking strip 80.

Figure 11:
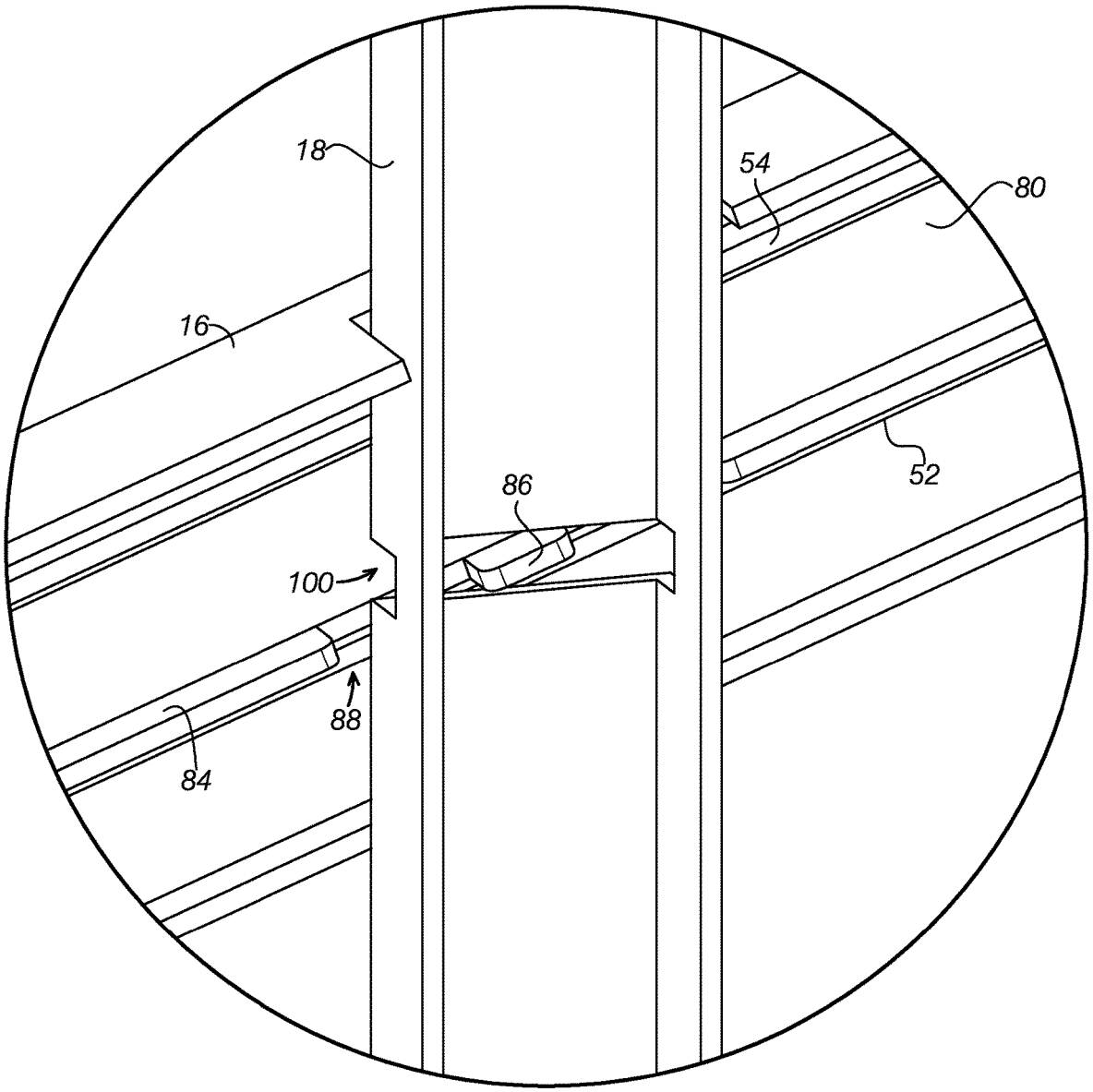
FIG. 11 illustrates a partially cut-away view showing pivoting of a picket on the pivoting locking bar of FIGS. 8A through 8C.

Referring also to FIG. 11, when the picket 18 is inserted into the middle rail 16, the pivot locking bar 80 is slid into place so that the finger 86 centrally aligns with the notch 100 formed in the picket 18. The cut-out portion 88 may be formed larger than the width of the picket 18 so that the picket 18 can pivot without interference from the extending portion 84 of the pivot locking bar 80. The cut out portion 88 on the pivot locking bar 18 on each side of the pivoting notch/finger 86 is, according to some embodiments of the present invention, within 75% to 95% of the width of the picket 18. This ensures rotation of the picket 18 of up to about 45 degrees, but limits additional unneeded rotation that weakens the fence panel. The width of the notch/finger 86 that engages into the picket 18 can be from about 45% to about 75% of the width/size of the cut out portion 88 on the pivot lock bar 18. A narrower lock finger 86 becomes too weak and a wider one limits the pivot angle required to achieve the 45-degree pivot for the pickets 18. Table 1 below provides exemplary dimensions for the pickets 18, the cut out portion 88 and the finger 86, as well as size of the cut out portion 88 as a percentage of the width of the picket 18, and the size of the finger 86 as a percentage of the size of the cut out portion 88. It should be noted that the dimensions in Table 1 are exemplary dimensions that may vary depending on application or needs of the user.

TABLE 1

Exemplary dimensions of various elements of the fence panel

| picket size | Lock Strip cut out portion size | Slot % of Picket size | Notch/finger - % of Slot size 50% | 60% | 70% | Total Left & Right Slots | + Finger |
|---|---|---|---|---|---|---|---|
| 0.63" | 0.55" | 88% | 0.28" | 0.33" | 0.39" | 1.43" | 229% |
| 0.75" | 0.63" | 84% | 0.32" | 0.38" | 0.44" | 1.64" | 218% |
| 1.00" | 0.79" | 79% | 0.39" | 0.47" | 0.55" | 2.05" | 205% |

Figure 9A:
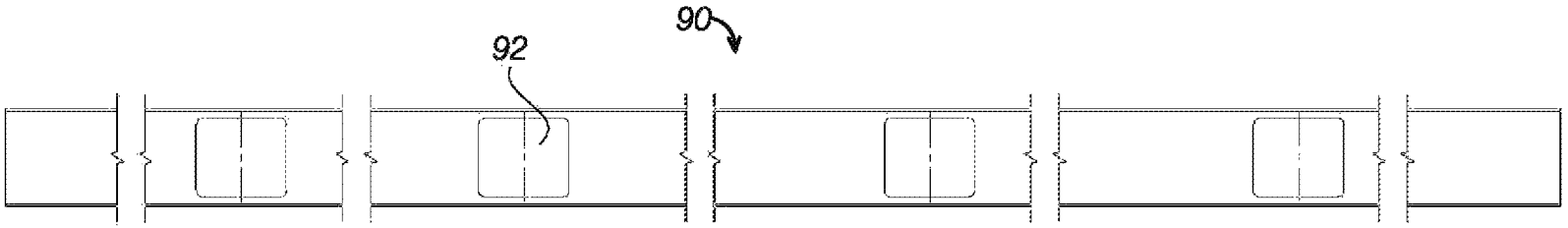
FIG. 9A illustrates a bottom view of a spacer strip usable in the fence panels of FIGS. 1A through 3B.
Figure 9B:
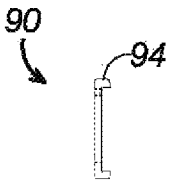
FIG. 9B illustrates an end view of the spacer strip of FIG. 9A.

Referring now to FIGS. 9A and 9B, a spacer strip 90 can fit into the top rail 14 between the top surface 56 and the upper tab 54 (see FIG. 5C). To ensure the pickets 18 do not move in the horizontal position when the pickets 18 are not going through a top routed rail or a middle supporting rail, such as when going into the top rail 14, the pickets 18 are held in place by the picket spacer strip 90 that has a small cavity 92 to accept the square picket head in the strip and hold the picket 18 from moving left or right in the top rail 14. The depth of the cavity 92 of the spacer strip 90 should be sufficient to hold the picket 18 in place. This spacer strip 90 can alternatively have a male finger (not shown) projecting that goes into the picket 18 instead of a female cavity 92 receiving the picket. Side arms 94 may extend from opposite sides of the spacer strip 90. The side arms 94 have a length sufficient to fit between the upper tab 54 and the top surface 56 of the top rail 14. In some embodiments, the cavity 92 may extend through the spacer strip 90 to form a hole to receive the tops of the pickets 18. In some embodiments, the spacer strip 90 may be formed integrally with the top rail 14, wherein the upper tabs 54 may not be necessary to hold the integral spacer strip in place.

In some embodiments, such as when the rails 14, 16 have screw holes 59, 69, as shown in FIGS. 5D and 6D, the spacer strip 90 may not be necessary, as screws disposed through the holes 59, 69 may hold the pickets 18 in place.

As described above, the pickets 18 may include notches 100 formed along one edge of the picket 18. The notches 100 may be cut into the pickets 18 as shown in FIGS. 10A through 10D, for example. While the Figures show the notches 100 formed as square notches, the notches 100 may be formed in various shapes and may have various widths and depths, depending on user needs and the particular application.

Figure 10A:
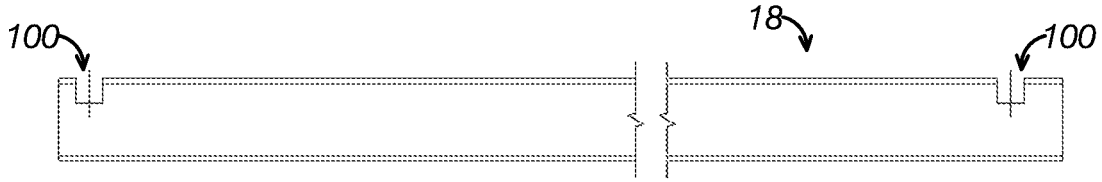
FIG. 10A illustrates a side view of a picket usable in the fence panel of FIGS. 3A and 3B.
Figure 10B:
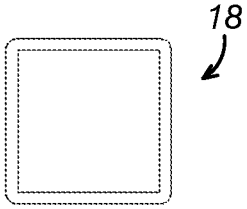
FIG. 10B illustrates an end view of the picket of FIG. 10A.
Figure 10C:
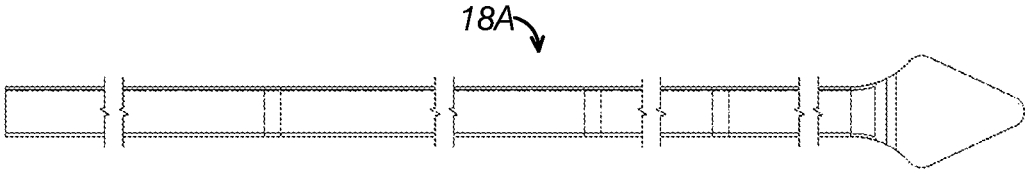
FIG. 10C illustrates a top view of a picket usable in the fence panel of FIGS. 4A and 4B.
Figure 10D:
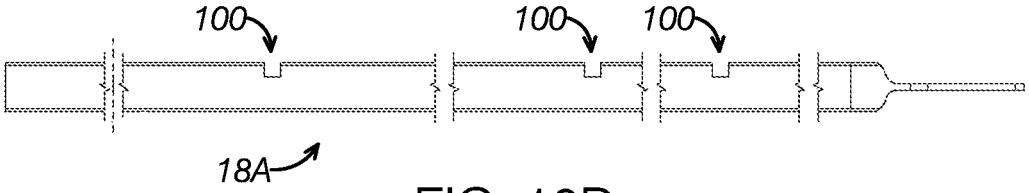
FIG. 10D illustrates a side view of the picket of FIG. 10C.

While FIG. 10A shows two notches 100 formed in the picket 18 (suitable, for example, for the fence panel 10B of FIGS. 3A and 3B), the location and number of notches 100 may vary depending on the design of the fence panel. For example, the fence panel 10 of FIGS. 1A and 1B would require three notches 100 in each of the pickets 10. Similarly, while FIGS. 10C and 10D show a picket with a designer head 18A having three notches 100, suitable for the fence panel 10C of FIGS. 4A and 4B, the pickets 18A may have a different number of notches 100, possibly at different locations. For example, for the fence panel 10A of FIGS. 2A and 2B, the picket 18A may include only two notches.

Figure 12A:
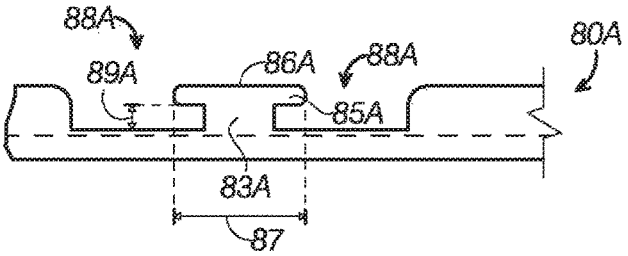
FIG. 12A illustrates a detailed top view of a pivoting locking bar according to an exemplary embodiment of the present invention.
Figure 12B:
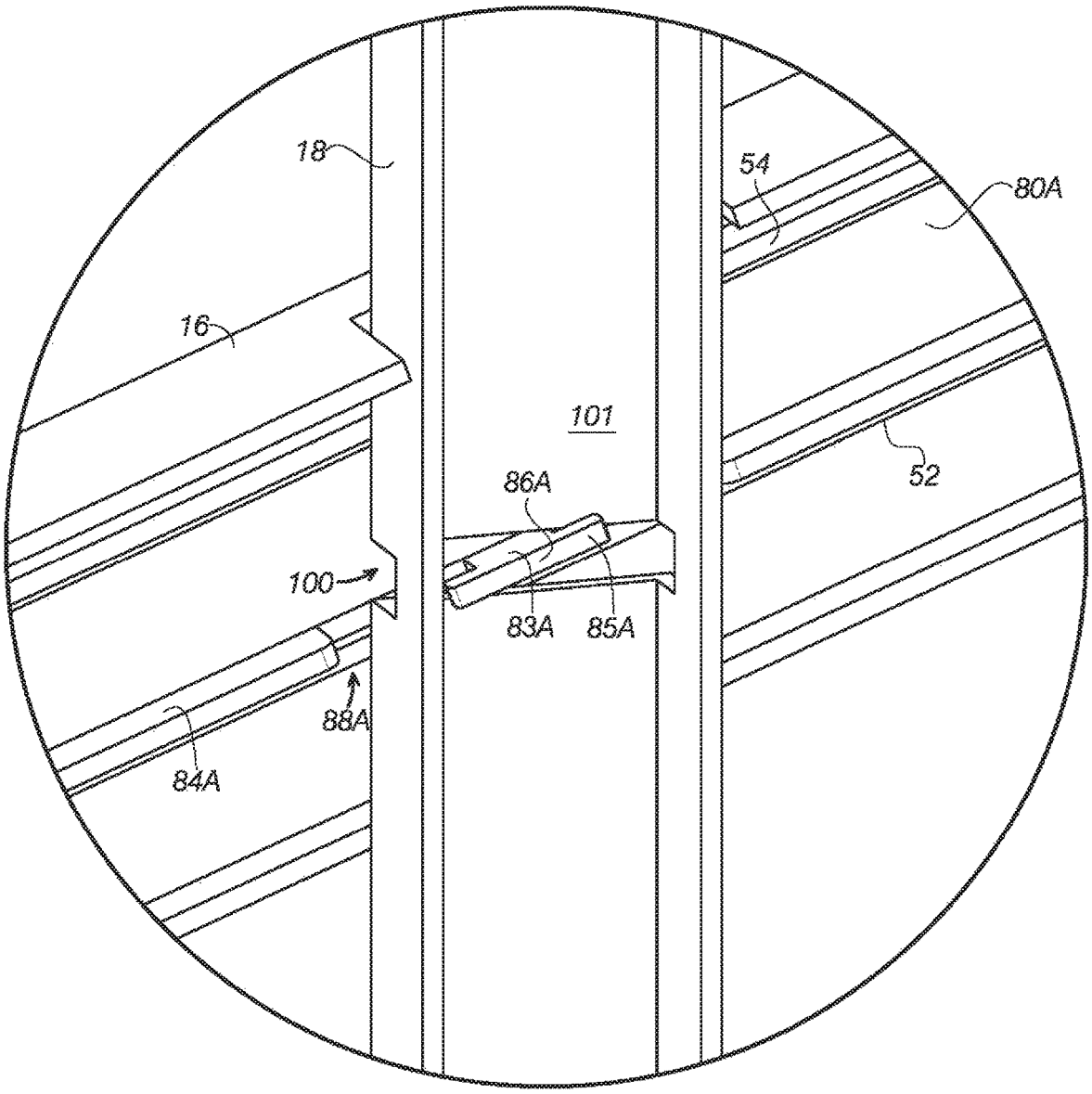
FIG. 12B illustrates a partially cut-away view showing pivoting of a picket on the pivoting locking bar of FIG. 12A.

Referring now to FIGS. 12A and 12B, in some embodiments, a pivot locking strip 80A may include a plurality of fingers 86A, similar to the fingers 86 described above, except that the fingers 86A are formed in a T-shape, with a base portion or neck 83A and extending arm portions 85A. The fingers 86A, like the fingers 86 described above, are formed between cut-out regions 88A, where the extending portion 84A of the pivot locking strip 80A is removed.

A length 87 of the fingers 86A, between ends of the arm portions 86A, is designed to be shorter than the width of the picket 18 so that the arm portions 86A can fit into the notch 100 in the picket 18 and the arm portions 85A can rest against a back side 101 of the picket 18, as shown in FIG. 12B. Typically, the length 87 of the fingers 86A can be longer that the width of the finger 86, described above. The neck 83A may raise the arm portions 85A away from the pivot locking strip 80A a distance 89A that is greater than or equal to a thickness of the picket 18. In some embodiments, the width of the neck 83A may be less than a height of the notch 100, allowing the picket 18 to pivot 360 degrees about the neck 83A, with the arm portions 85A retaining the picket 18 to the pivot locking strip 80A at least partially throughout such rotation.

The T-shape design of the fingers 86A allows the pickets 18 to be secured to the pivot locking strip 80A by sandwiching the picket 18 between the arm portions 85A and the rail 16.

While the pivot locking bars 80, 80A are shown to extend over a plurality of pickets—typically along all of the pickets in a fence panel 10—in some embodiments, the pivot locking strips 80, 80A may be designed to span from one to several pickets, depending on the particular application.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Claim elements and steps herein may have been numbered and/or lettered solely as an aid in readability and understanding. Any such numbering and lettering in itself is not intended to and should not be taken to indicate the ordering of elements and/or steps in the claims.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

What is claimed is:

1. A fence panel comprising:

a plurality of pickets, each comprising a central wall having a pair of sidewalls extending rearward from opposing sides thereof;

at least one notch formed in each of the plurality of pickets, wherein each notch extends across the central wall, through opposing faces thereof, and extends through the pair of sidewalls to define a pair of aligned cut-outs therein, and forming an indentation viewable from a position orthogonal to the plurality of pickets;

a rail having a top surface, a rail first side extending from the top surface, and a second opposite side extending from the top surface; and a lock bar formed with a lock bar first side positioned along an inside surface of the rail first side, and a planar extension extending outward from the lock bar first side, wherein the lock bar includes a picket receiving section corresponding to each of the pickets, each picket receiving section comprising a pair of adjacent cut-out sections extending through the planar extension and defining a finger therebetween which fits into a corresponding notch in one of the pickets;

wherein the lock bar is slidable along the inside surface of the rail first side when the pickets are assembled within the rail, with the notches in the pickets facing the rail first side and being aligned to permit the planar extension to pass therethrough, each finger fitting at least partially into a corresponding notch in one of the plurality of pickets such that the picket can pivot about the finger and such that a portion of the finger extends behind a back surface of the picket when the picket is pivoted.

2. The fence panel of claim 1, further comprising at least a first and second tab extending into an interior region of the rail from at least the rail first side, wherein the lock bar fits between the first and second tabs.

3. The fence panel of claim 1, wherein the lock bar is an elongated member formed in an L shape spanning each of the plurality of pickets in the fence panel.

4. The fence panel of claim 1, wherein the width of the picket receiving section is wider than a width of the picket.

5. The fence panel of claim 1, wherein the predetermined angle is about 45 degrees in each direction from an initial position where the picket is perpendicular with the rail.

6. The fence panel of claim 1, wherein the fingers are formed in a T-shape, wherein arms of the T-shape are operable to fit against a back surface of the pickets when the pickets are pivoted relative to the rail.

7. The fence panel of claim 1, further comprising posts at each end of the rails, where the rails are at opposing ends thereof to the posts.

8. The fence panel of claim 1, wherein the at least one notch includes two or three notches formed in each of the plurality of pickets.

9. The fence panel of claim 1, wherein the rail includes a middle rail having a plurality of holes formed along the top surface thereof, wherein one of the plurality of pickets is positioned in each of the plurality of holes.

10. The fence panel of claim 1, wherein the rail includes a top rail having a solid top surface.

11. The fence panel of claim 10, further comprising a spacer strip formed along an interior of the top surface of the top rail, the spacer strip including a plurality of cavities for receiving ends of each of the plurality of pickets.

12. The fence panel of claim 11, further comprising upper tabs disposed on the first and second sides of the top rail, the upper tabs securing the spacer strip against the top surface of the top rail.

13. A fence panel comprising:

a first picket and a second picket, each comprising a central wall having a pair of sidewalls extending rearward from opposing sides thereof;

a notch formed in each of the first and second pickets, wherein the notch extends across the central wall, through opposing faces thereof, and extends through the pair of sidewalls to define a pair of aligned cut-outs therein, and forming an indentation viewable from a position orthogonal to the pickets;

a rail having a top surface, a rail first side extending from the top surface, and a second opposite side extending from the top surface, the rail positioned over each notch of the first and second pickets; and a lock bar formed as an L-shaped elongated member with a lock bar first side positioned along an inside surface of the rail first side, and a planar extension portion extending outward from the lock bar first side, wherein the lock bar includes:

a first and second picket receiving section, one such picket receiving section corresponding to each of the first and second pickets; and each of the first and second picket receiving sections comprising a pair of adjacent cut-out sections extending through the planar extension and defining a finger therebetween which fits into a corresponding notch in one of the pickets, wherein the lock bar is slidable along the inside surface of the rail first side when the pickets are assembled within the rail, with the notches in the pickets facing the rail first side and being aligned to permit the planar extension to pass therethrough; and wherein each finger of the first and second picket receiving sections fits into the notch of each of the first and second pickets, respectively, permitting the first and second pickets to pivot at least up to a predetermined angle about the fingers and such that a portion of the finger extends behind a back surface of the picket when the picket is pivoted.

14. The fence panel of claim 13, further comprising at least a first and second tab extending into an interior region of the rail from at least the first side of the rail.

15. The fence panel of claim 13, wherein the width of the picket receiving section is wider than a width of the picket.

16. The fence panel of claim 13, wherein the predetermined angle is about 45 degrees in each direction from an initial position where the picket is perpendicular with the rail.

17. A fence panel comprising:

a plurality of pickets, each comprising a central wall having a pair of sidewalls extending rearward from opposing sides thereof;

at least two notches formed in each of the plurality of pickets, wherein each notch extends across the central wall, through opposing faces thereof, and extends through the pair of sidewalls to define a pair of aligned cut-outs therein, and forming an indentation viewable from a position orthogonal to the plurality of pickets;

at least two rails, each having a top surface, a rail first side extending from the top surface, and a second opposite side extending from the top surface, the rails positioned over each of the at least two notches;

a pair of posts, each secured at opposite ends of the at least two rails;

a plurality of lock bars, each formed as an L-shaped elongated member with a lock bar first side positioned along an inside surface of the rail first side of a corresponding one of the rails, and a planar extension portion extending outward from the lock bar first side, wherein the lock bar includes a plurality of picket receiving sections, one such picket receiving section corresponding to each of the plurality of pickets, each of the picket receiving sections including a pair of adjacent cut-out sections extending through the planar extension and defining a T-shaped finger therebetween which fits into a corresponding notch in one of the pickets, wherein each lock bar is slidable along the inside surface of the rail first side when the pickets are assembled within the rails, with the notches of the pickets facing the rail first side and being aligned to permit the planar extension to pass therethrough, each finger of the planar extension fitting into a corresponding notch in one of the pickets such that the picket can pivot about the finger and such that a portion of the finger extends behind a back surface of the picket when the picket is pivoted; and wherein at least one of the at least two rails includes a middle rail having a plurality of holes formed along the top surface thereof, wherein one of the plurality of pickets is positioned in each of the plurality of holes.

18. The fence panel of claim 17, wherein one of the at least two rails include a top rail having a solid top surface.

19. The fence panel of claim 18, further comprising:

a spacer strip disposed along an interior of the top surface of the top rail, the spacer strip including a plurality of cavities for receiving ends of each of the plurality of pickets; and upper tabs disposed on the first and second sides of the top rail, the upper tabs securing the spacer strip against the top surface of the top rail.

20. The fence panel of claim 17, further comprising at least a first and second tab extending into an interior region of the rails from at least the rail first side, the lock bar first side fitting between the first and second tabs.

* * * * *